US006536747B2

(12) United States Patent
Burns et al.

(10) Patent No.: US 6,536,747 B2
(45) Date of Patent: Mar. 25, 2003

(54) CARBURETOR VENT CONTROL

(75) Inventors: Michael P. Burns, Millington, MI (US); George M. Pattullo, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/909,540

(22) Filed: Jul. 20, 2001

(65) Prior Publication Data

US 2003/0015808 A1 Jan. 23, 2003

(51) Int. Cl.[7] ..... F02M 1/16
(52) U.S. Cl. ..... 261/35; 261/63
(58) Field of Search ..... 261/63, 35, 69.1, 261/69.2, DIG. 68, DIG. 74

(56) References Cited

U.S. PATENT DOCUMENTS

| | | | | | |
|---|---|---|---|---|---|
| 3,549,133 | A | | 12/1970 | Frankowski et al. | 261/51 |
| 3,706,444 | A | | 12/1972 | Masaki et al. | 261/39.5 |
| 3,743,254 | A | | 7/1973 | Tuckey | 261/34.2 |
| 3,931,372 | A | * | 1/1976 | Pierlot | 261/63 X |
| 4,122,809 | A | * | 10/1978 | Iwasa | 261/DIG. 74 |
| 4,190,618 | A | * | 2/1980 | Sheffer | 261/DIG. 74 |
| 4,217,313 | A | * | 8/1980 | Dmitrievsky et al. | 261/DIG. 74 |
| 4,509,471 | A | | 4/1985 | Eberline et al. | 123/179.16 |
| 4,784,096 | A | | 11/1988 | Eberline | 123/179.16 |
| 5,002,705 | A | | 3/1991 | Kohler | 261/35 |
| 5,711,901 | A | * | 1/1998 | Berg et al. | 261/35 |

FOREIGN PATENT DOCUMENTS

| | | | |
|---|---|---|---|
| DE | 622499 | 11/1935 | |
| DE | 1076442 | 2/1960 | |
| GB | 2032521 | * 5/1980 | 261/DIG. 74 |
| JP | 58185961 | 10/1983 | |
| JP | 08004593 | 1/1996 | |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor preferably of a diaphragm type for an internal combustion engine has a low speed circuit for starting and idling of a cold engine. An air bleed line of the low speed circuit communicates between an inlet of a fuel and air mixing passage of the carburetor and an emulsifying chamber of the low speed circuit. Fuel flows to the emulsifying chamber from a fuel metering chamber and is regulated by a low speed idling adjustment needle screw. The bleed air and the fuel mixes within the emulsifying chamber and flows into the mixing passage between the throttle valve and the outlet of the mixing passage. Promoting this flow is a high vacuum produced by cranking and idling of the engine and accentuated by the substantially closed throttle valve. The fuel-and-air mixture is rich during cold idling as a result of the closed air bleed line. When the engine warms up, the air bleed line is opened via the restrictor valve.

14 Claims, 3 Drawing Sheets

CARBURETOR VENT CONTROL

FIELD OF THE INVENTION

This invention relates to a carburetor for small combustion engines and more particularly to a low speed fuel circuit to facilitate quick starting and warm-up of engines.

BACKGROUND OF THE INVENTION

A small internal combustion engine requires extra fuel to run during "cold start" conditions. Traditionally, an automatic heat controlled choke is used on a diaphragm carburetor common with small engines. This choke blocks or restricts the air intake passage to the extent that the vacuum created by the moving piston within the engine will be higher than normal in the fuel-and-air mixing passage and thus will receive an increased quantity of fuel from the carburetor supply nozzle and delivers it to the engine cylinders. After the engine has started and has some time to develop heat, in the area of the automatic choke, there will be an automatic release of the choke to allow normal air flow into the mixing passage. These automatic chokes are expensive to manufacture and too costly for small engines.

With some small hand-held engines, such as chainsaws, weed cutters and/or trimmers, an extra quantity of fuel is forced into the engine by a manual priming pump or apparatus. This may facilitate the initial starting but usually will not provide sufficient fuel to keep the engine running until it warms up to the point that is needed to operate under normal carburetor conditions.

SUMMARY OF THE INVENTION

This invention provides a carburetor for a small engine capable of providing extra fuel for a cold start and cold running of an engine at idle conditions. A low speed fuel circuit has an air bleed line which communicates between an emulsification chamber and the inlet of a fuel-and-air mixing passage of the carburetor and is opened and closed by a restricting valve. A throttle valve is disposed rotatably within the mixing passage between a venturi and an outlet of the passage. The emulsification chamber has an outlet or low speed nozzle which communicates with the mixing passage downstream of the throttle valve when closed. Preferably, a low speed fuel flow control valve controls the amount of fuel entering the emulsification chamber, and a combination of the throttle valve and the air bleed shut off valve controls the amount of air which mixes in the emulsification chamber with the fuel required for engine idling conditions. When the engine is starting and idling cold, the restricting valve is closed manually and the emulsification chamber emits a rich mixture of fuel-and-air into the mixing passage downstream of the throttle valve. When the engine is starting and idling warm, the restricting valve is opened thereby providing additional air flow to the emulsification chamber for mixing with the fuel therein to produce a leaner fuel-and air-mixture emitted from the low speed nozzle. Preferably the restricting valve has a rotary shaft which may be mounted in the same location as a shaft of a common choke valve of a conventional carburetor.

Objects, features and advantages of this invention include providing a low speed circuit capable of flowing a richer fuel-and-air mixture to a small engine when the engine is starting and idling at cold conditions. The low speed circuit provides quicker cold engine start-UPS and significantly improves idling of the engine when cold. Because the restricting valve may replace a common choke shaft, this invention saves in manufacturing costs by reducing variability's between carburetor models. The invention provides an extremely compact construction and arrangement, a relatively simply design, extremely low cost when mass produced, and is rugged, durable, reliable, requires little maintenance and adjustment in use, and in service has a long useful life.

DESCRIPTION OF THE DRAWINGS

These and other objects, features and advantages of this invention will be apparent from the following detailed description, appended claims, and accompanying drawings in which:

DETAILED DESCRIPTION OF THE PREFERRED EMBODIMENTS

Figure 2:
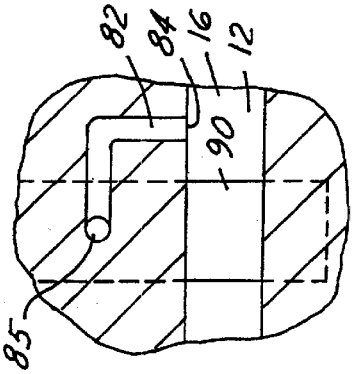
FIG. 2 is a fragmentary sectional view of an air bleed shut-off valve of the low speed circuit taken along line 2—2 of FIG. 1.
Figure 1:
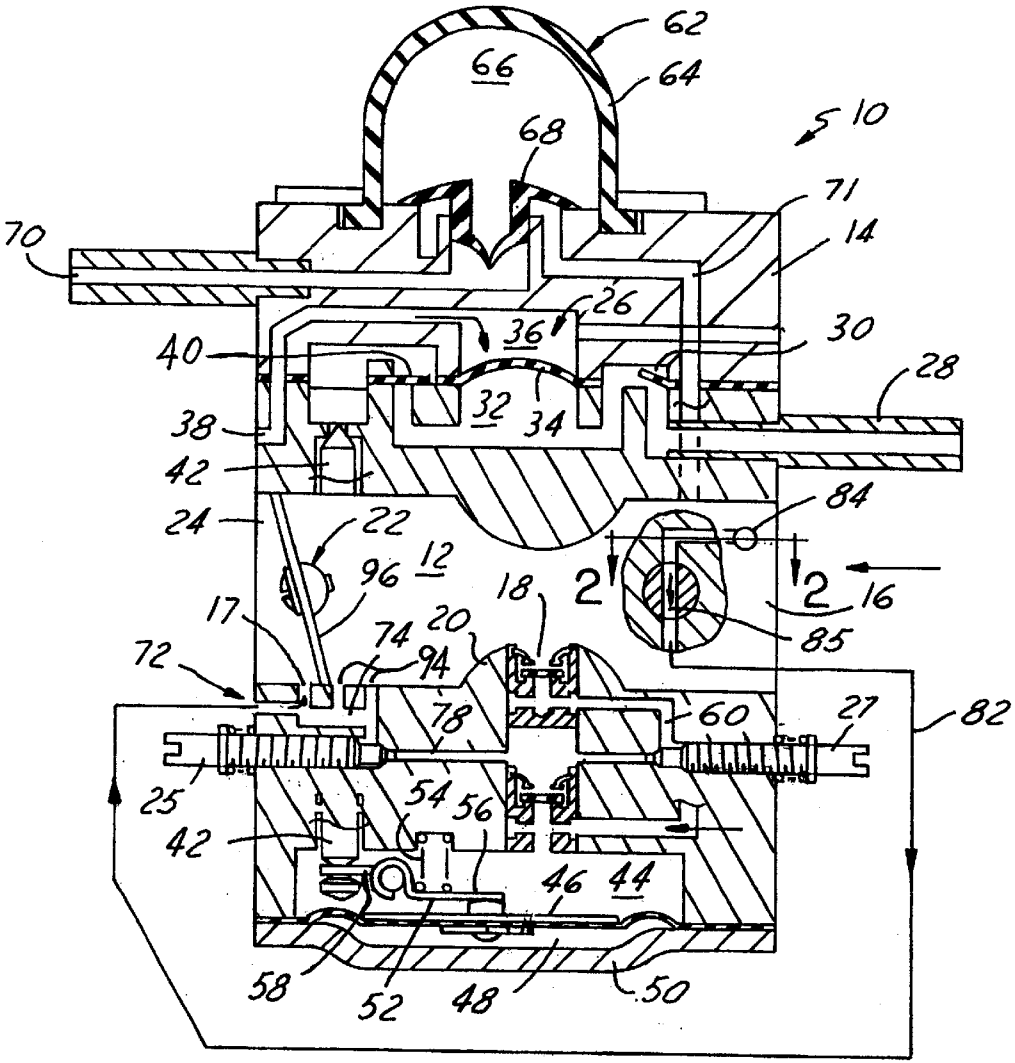
FIG. 1 is a cross section side view of a diaphragm type carburetor with a low speed circuit of the present invention.

FIGS. 1 and 2 illustrate a diaphragm carburetor 10 embodying the invention which is typically used for small two and four-cycle engine applications, however, the same principles can easily be applied in a float-type carburetor for either a two or four-stroke engine. Carburetor 10 has a fuel-and-air mixing passage 12 which is defined by and extends through a body 14 of the carburetor 10. Air at near atmospheric pressure flows through an inlet 16 of the passage 12 where it mixes with fuel from either an idle nozzle 17 located downstream from a throttle valve 22, or a main nozzle 18 located upstream from the throttle valve at a venturi 20 disposed within the passage 12 and defined by the body 14. The throttle valve 22 is positioned between an outlet 24 and the venturi 20 of the passage, and rotates therein to control the amount of a fuel-and-air mixture flowing to the engine. The rate of fuel flow through the idle nozzle 17 is partially controlled by an idle or low speed flow control valve 25 during idle conditions and the fuel flow through the main nozzle 18 is controlled by a high speed flow control valve 27 during high engine speeds or high air flow conditions through the venturi 20. Valves 25, 27 are preferably threaded needle valves.

A diaphragm type fuel pump 26, configured integrally within the body 14, receives fuel from a remote fuel reservoir or tank (not shown) which is connected to a fuel inlet nipple 28 projecting rigidly outward from the body 14. Fuel then flows through a check valve 30 within the body 14 and into a lower chamber 32 directly beneath a diaphragm 34 of the pump 26. The diaphragm 34 is compelled to flex into and out of the lower chamber 32 via pressure pulses generated by the engine and sent to an air chamber 36 of the pump 26 disposed directly above the diaphragm 34. Air chamber 36 is defined by the body 14 and receives the pressure pulses through a pulse inlet 38. Typically these pressure pulses are from the engine crankcase or the carburetor mixing passage 12.

The reciprocating or flexing movement of diaphragm 34 pumps the fuel through a second check valve 40, then pass a control valve 42, and into a fuel metering chamber 44. Chamber 44 is defined by the body 14 and a second diaphragm 46 which flexes in order to hold the pressure within the metering chamber 44 substantially constant. In order to hold the metering chamber 44 to a constant pressure, the opposite or bottom side of second diaphragm 46 is exposed to a constant reference pressure, or atmospheric pressure. Protecting the diaphragm 46 is a cover plate 50 which engages the bottom end of the body 14 and surrounds the perimeter of the diaphragm 46 thereby forming an atmospheric chamber 48 there between.

As fuel flows from the metering chamber 44 into the sub-atmospheric fuel-and-air mixing passage 12, the diaphragm 46 moves upward into the chamber 44 causing a first end 56 of a pivot arm 52, located within the metering chamber 44, to also move upward. The pivot arm 52 thereby pivots about a pivot point 54 causing an opposite second end 58 of the pivot arm 52, which is engaged pivotally to the flow control valve 42, to move downward thereby opening the valve. Fuel then flows into the metering chamber 44 until the diaphragm 46 lowers, essentially enlarging the fuel metering chamber 44, which in turn pivots the arm 52 and closes the valve 42. In this way, the fuel in metering chamber 44 is held at a substantially constant and near atmospheric pressure. Fuel is delivered from the metering chamber 44 to the main nozzle 18 via a main fuel channel 60 intersected by the high speed flow control valve 27. The fuel flow is created by the suction or difference between the pressure, typically at atmospheric, in the metering chamber and the sub-atmospheric pressure prevailing in the mixing passage 12 during normal operation when the throttle valve 22 is open.

Without cranking or running the engine, the diaphragm pump 26 does not receive the engine pressure pulses necessary to supply fuel from the reservoir into the metering chamber 44. Therefore, a manually operated suction or priming pump 62 is incorporated into the carburetor, to remove any air from the metering chamber 44 and/or the lower fuel chamber 32 of the fuel pump 26. The suction pump 62 has a domed cap 64 made of a resilient material such as Neoprene rubber which defines a pump chamber 66 located generally at the top of the body 14. Disposed substantially centrally within pump chamber 66 is a mushroom shape dual check valve 68. When the resilient dome cap 66 is depressed, air is expelled through the center of the check valve 68 and through an atmospheric outlet port 70. As the dome cap 64 restores itself to a natural or unflexed initial state, the resultant suction produced within the chamber 66 pulls the mushroom shaped check valve 68 upward, consequently communicating the chamber 66 with an internal passage or channel 71 which communicates with the fuel metering chamber 44, and thereby removes any air or fuel vapor from the metering chamber 44 and the chamber 32 of the diaphragm pump.

During warm or cold idling conditions of the engine, the throttle valve 22 is substantially closed, typically about ninety-five percent. This closure greatly reduces air flow through the mixing passage 12 and produces a high vacuum condition downstream of the throttle valve 22. An idling or low speed circuit 72 of the carburetor 10 utilizes this high vacuum to discharge fuel, via the idling nozzle 17, into the mixing passage 12 down stream of the throttle valve 22 where it mixes with air and is supplied to the engine. Nozzle 17 communicates with an emulsifying chamber 74 of the low speed circuit 72. Prior to discharge of the fuel necessary for engine idling, the fuel first flows into the emulsifying chamber 74 from the metering chamber 44. The rate or quantity of this fuel flow is controlled via the manually adjustable control valve 25 which intersects a low speed fuel channel 78 communicating between the two chambers.

To enhance fuel mixing, a series of acceleration ports 94 communicate between the mixing passage 12, upstream of throttle valve 22, and the emulsifying chamber 74. Ports 94 allow a portion of the total engine idling air flow to bypass the throttle valve 22, wherein the bypassed air flow mixes with the fuel within the emulsifying chamber 74 producing a rich fuel-and-air mixture which is discharged into the high vacuum portion of the passage 12 through the idling nozzle 17 for mixing with the remainder of the engine idling air flow. The ports 94 are preferably aligned along the axis of the passage 12 and within the sweeping action of a plate 96 of the throttle valve 22. As the throttle valve 22 opens, the plate 96 sweeps past the ports 94, one-by-one, reducing the air pressure differential or vacuum downstream of the throttle valve 22, thus reducing air flow and mixing within the emulsifying chamber 74, and the overall fuel contribution of the low speed circuit 72.

More specific to the present invention, as air bleed line 82 of the low speed circuit 72 communicates between a clean air source at substantially atmospheric pressure and the emulsifying chamber 74. The clean air source is preferably drawn from the mixing passage 12, upstream of the venturi 20 and near the inlet 16. During warm engine idle conditions, air flows through the bleed line 82 to the emulsifying chamber 74. During cold engine start and idle conditions, the bleed line is isolated or closed, preventing additional clean air flow from entering the emulsifying chamber 74, thereby, supplying a richer fuel-and-air mixture to the engine. Once the engine has warmed up, the rich mixture is no longer needed and the bleed line can be opened, manually to supply air to the chamber 74. Alternatively, a clean air source can be gained directly from an air filter box remote from carburetor 10 or any other variety of external clean air sources at atmospheric pressure by utilizing an external tube as the bleed line 82 and a remote restricting valve mounted thereon (not shown).

Figure 3:
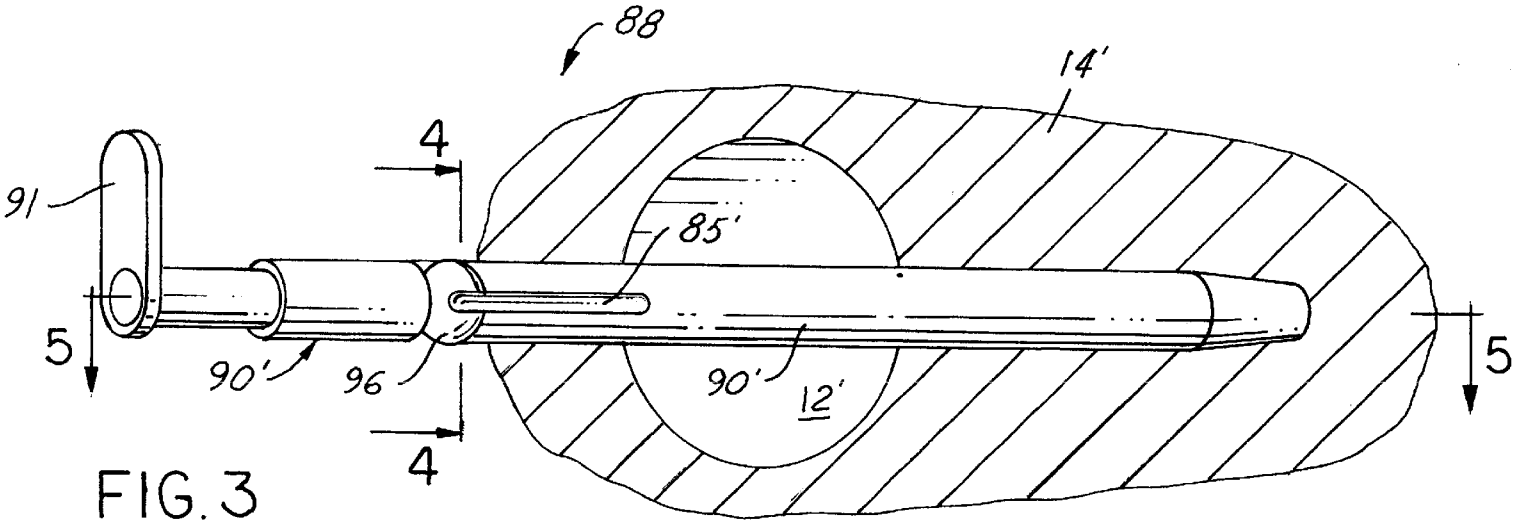
FIG. 3 is a partial perspective and partial cross section view of a second embodiment of the air bleed shut-off valve with a seat retainer and a resilient member removed to show detail.

Referring to FIGS. 1 through 3, opening and closing of the bleed line 82 is preferably controlled by a rotary restrictor valve 88 which is formed preferably by a shaft 90 which transverses the passage 12 upstream of the venturi 20. A manual actuator lever 91 is mounted to an end of the shaft 90 and is exposed externally to the body 14 of the carburetor 10. Pivoting of the lever 91 by the user rotates the shaft 90, preferably by approximately ninety degrees, to open and close the bleed line 82. Line 82 has an air bleed inlet port 84 defined on or penetrating the wall of the cylindrical passage 12 near the inlet 16. Line 82 is routed internally in the body 14 from the inlet port 84 to a groove or bore 85 which extends laterally through the shaft 90 and intersects the line 82. Rotation of the shaft 90 will align and miss-align the bore 85 with the line 82, thereby, opening or closing the valve 88. Utilization of the shaft 90, which may resemble a choke shaft, minimizes the cost of manufacture by reducing the number of varying parts between carburetor models (i.e. Those carburetors with and without choke valves).

When starting a cold engine, the manual lever of the restricting valve 88 is rotated approximately ninety degrees thereby miss-aligning groove 85 with the air bleed line 82 and effectively cutting off any air bleed through the line 82. Without an air bleed, the emulsification within the chamber 74 produces a richer fuel and air mixture which is needed for quick starts and idling of a cold engine. This mixture flows through the idling nozzle 17 into the mixing passage 12 between the throttle valve 22 and the outlet 24 and eventually into the crankcase of the idling cold engine. When the running engine reaches a warm or hot condition, the manual lever of the restrictor valve 88 is returned to its original position, thereby, aligning the bore 85 with the air bleed line 82. Air then flows from the air bleed inlet 84 through the line 82, and into the emulsifying chamber 74 as a result of the high vacuum produced by the running engine and accentuated by the closed throttle valve 22. This promotes a leaner fuel-and-air mixture for idling conditions of a warm running engine and startup of a warm engine.

Figure 4:
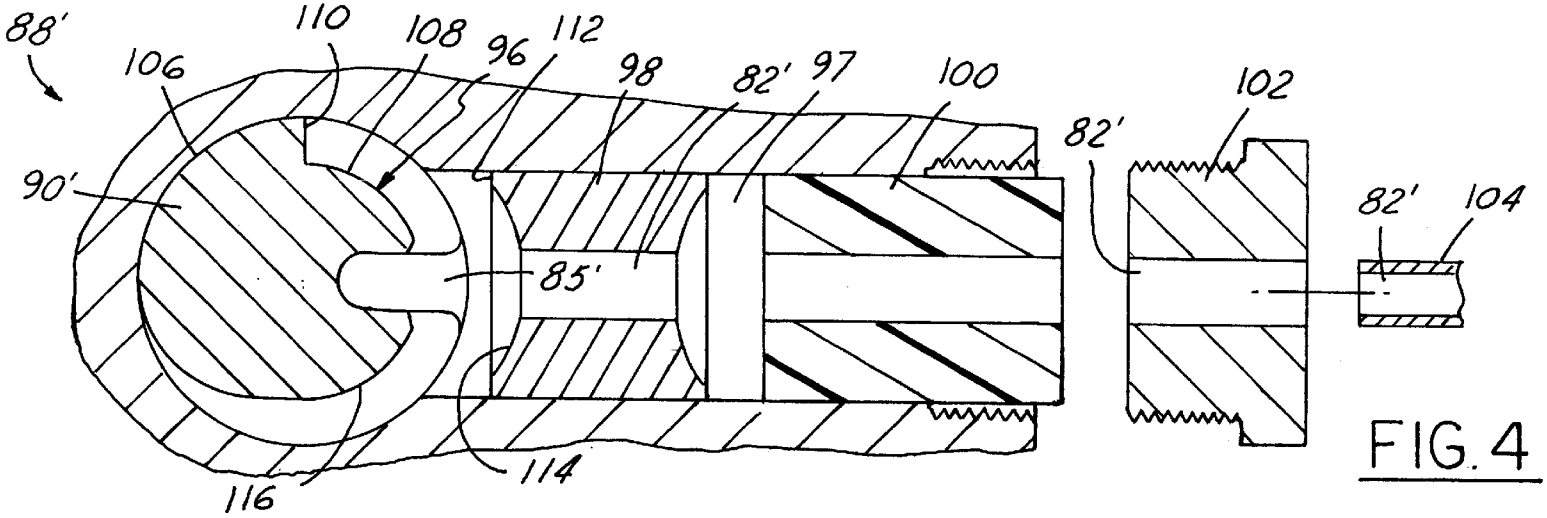
FIG. 4 is an exploded cross section view of the air bleed shut-off valve taken along line 4—4 of FIG. 3.
Figure 5:
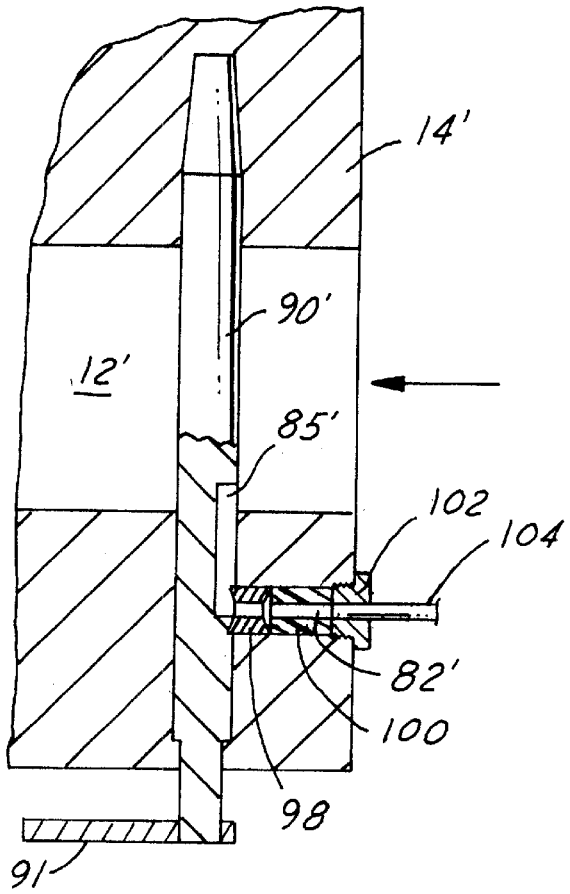
FIG. 5 is a cross section view of the air bleed shut-off valve taken along line 5—5 of FIG. 3.

FIGS. 3 through 5 illustrate a second embodiment of a valve 88', of the present invention wherein a bore or groove 85', but extends longitudinally along the shaft 90', not laterally through the shaft, and is defined by the outer radial surface of the shaft. The groove 85' extends from a semi-spherical shaped seat portion 96 of the shaft 90' to a portion of the shaft exposed within the mixing passage 12'. Valve 88' eliminates the need for the inlet port 84 of the first embodiment. Extending laterally outward from the 10 seat portion 96 of the shaft 90' and defined by the carburetor body 14' is a bore or well 97. A seat insert 98, preferably made of plastic, is biased against the seat portion 96 by a resilient member 100 which is preferably made of Buena-n rubber, or the like. Both the seat insert 98 and the member 100 are aligned longitudinally within the well 97 and retained therein by a plug 102 press fitted or threaded into the body 14. The air bleed line 82' extends concentrically and longitudinally through the plug 102, the resilient member 100 and the seat insert 98 so as to communicate salably with the groove 85'. The plug 102 is also a fitting, connecting to a tube 104 which can be routed externally of the carburetor body 14 and connected to the emulsifying chamber 74 at its opposite end.

The seat portion 96 of the shaft 90' is preferably formed radially inward of the radial outer limits or surface 106 of the shaft 90'. During assembly, this will permit sliding of the shaft 90' into the carburetor body 14'. The seat portion 96 has a spherical section 108 generally extending circumferentially outward from one longitudinal side of the groove 85' to a stop surface 110. As shown in FIG. 4, when the shaft 90' is rotated in a clockwise direction, an outer circumferential edge 112 of the seat insert 98 will engage the stop surface 110 preventing farther rotation and effectively seals-off the groove 85' from the line 82'. When sealed, the spherical section 108 is engaged salably to a concave surface 114 of the seat insert 98 which is disposed radially inward from the circumferential edge 112. The seat portion 96 of the shaft 90' also has an oval-like section 116 extending circumferentially outward from an opposite longitudinal side of the groove 85' and tapering gradually into surface 106 of the shaft for ease of manufacture.

Figure 6:
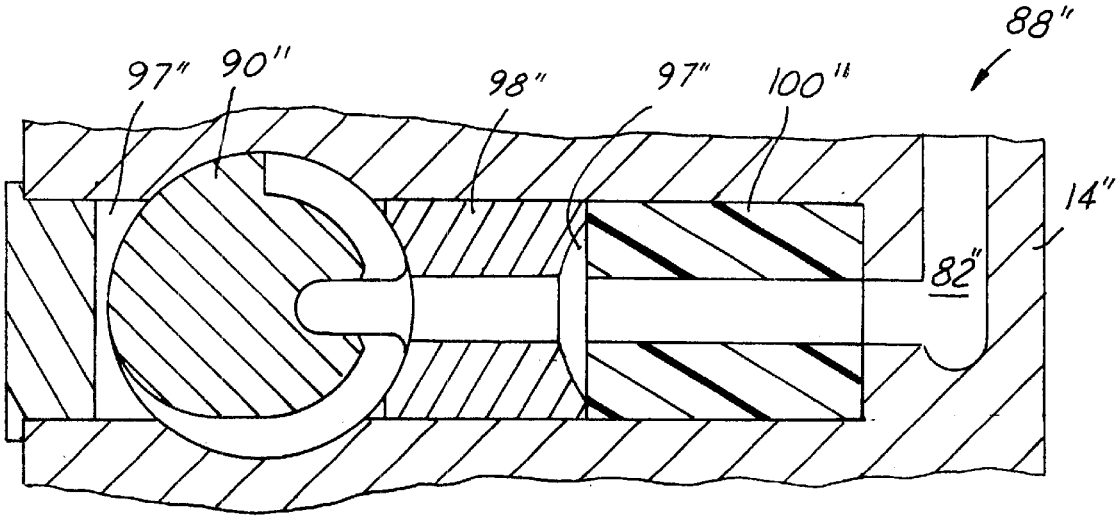
FIG. 6 is a broken cross section view of a third embodiment of the air bleed shut-off valve.

FIG. 6 illustrates a third and preferred embodiment of the shut-off valve 88" in which the bore or well 97" is machined. The well 97" from an external surface of body 14" and transversely to and through the bore which receives the shaft 90". The resilient member 100" and the seat insert 98" are inserted into the well 97" from a reverse direction to that of the shut-off valve 88'. The resilient member 100" is therefore axially compressed between the body 14" which defines the bottom of the well 97" and the seat insert 98". Therefore, the plug 102 of valve 88', is not required to retain the seat insert and resilient member within the well 97". Instead, the seat insert and resilient member are assembled or inserted into the well 97" and slid past the bore of the yet to be inserted shaft 90". The shaft 90" is then inserted into its bore and press fitted beyond the seat insert 98" against the resilient forces of the member 100" until the seat insert 98" snap fits into the seat portion 96" of the shaft 90". The bleed line 82" of valve 88" is contained within and defined by the carburetor body 14". The open end of the bore or well 97" is closed by a plug press fit therein.

While the forms of the invention herein disclosed constitute a presently preferred embodiment, many others are possible. It is not intended herein to mention all the possible equivalent forms or ramification of the invention. It is understood that terms used herein are merely descriptive, rather than limiting, and that various changes may be made without departing from the spirit or scope of the invention.

We claim:

1. A carburetor for an internal combustion engine comprising:

a body;

a fuel-and-air mixing passage extending through the body, the mixing passage having an inlet, an outlet, and a venturi disposed between the inlet and outlet;

a throttle valve disposed within the mixing passage between the venturi and the outlet to control flow through the mixing passage;

a low speed fuel nozzle communicating with the mixing passage adjacent the throttle valve when it is closed;

an air bleed line communicating between an inlet port and the low speed nozzle, the inlet port communicating with atmosphere, the low speed nozzle communicating with the mixing passage between the outlet and the throttle valve; and an air bleed shut-off valve in the air bleed line having a closed position preventing air flow to the low speed nozzle through the air bleed line for cold starting of the combustion engine and an open position for hot idle and high speed operating conditions at the combustion engine.

2. The carburetor set forth in claim 1 wherein the inlet port of the air bleed line is located in the mixing passage between the inlet and the venturi.

3. A carburetor for an internal-combustion engine comprising:

a body;

a fuel-and-air mixing passage extending through the body, the mixing passage having an inlet, an outlet, and a venturi disposed between the inlet and outlet;

a throttle valve disposed within the mixing passage between the venturi and the outlet to control flow through the mixing passage;

a low speed fuel nozzle communicating with the mixing passage adjacent the throttle valve when it is closed;

an air bleed line communicating between an inlet port and the low speed nozzle, the inlet port communicating with atmosphere, the low speed nozzle communicating with the mixing passage between the outlet and the throttle valve and the inlet port of the air bleed line is located in the mixing passage between the inlet and the venturi;

an air bleed shut-off valve in the air bleed line; and the air bleed shut-off valve is a rotary valve having a shaft traversing the mixing passage, the shaft having a groove extending longitudinally along the shaft from the air bleed line to the mixing passage, and the groove is exposed within the mixing passage to define the inlet port.

4. The carburetor set forth in claim 3 wherein the air bleed restricting valve further comprises:

the shaft having a semi-spherical seat portion, the groove extending from the seat portion to the mixing passage;

a well defined by the body and communicating with the seat portion of the shaft;

a resilient member disposed within the well; and a seat insert disposed within the well and engaged between the seat portion and the resilient member, the air bleed line extended through the resilient member and the seat insert.

5. The carburetor set forth in claim 4 wherein the seat insert has a concave surface engaged slidably to the seat portion of the shaft.

6. The carburetor set forth in claim 5 wherein the resilient member is compressed directly between the body and the seat insert.

7. The carburetor set forth in claim 6 further comprising an emulsifying chamber defined by the body of the carburetor and communicating between the air bleed line and the low speed nozzle.

8. A carburetor for an internal combustion engine comprising:

a body;

a fuel-and-air mixing passage extending through the body;

a throttle valve disposed within the body;

a fuel chamber carried by the body;

a high speed circuit having a main nozzle, communicating with the fuel-and-air mixing passage upstream of the throttle valve, and a main fuel channel communicating between the main nozzle and the fuel chamber;

a low speed circuit having an emulsifying chamber, a low speed nozzle, an air bleed line, a shut-off valve, a fuel port, and a low speed fuel channel, the low speed nozzle providing an emulsified fuel-and-air mixture from the emulsifying chamber to the fuel-and-air mixing passage downstream of the throttle valve, the air bleed line communicating between the emulsifying chamber and the mixing passage upstream of the throttle valve, the shut-off valve communicating with the air bleed line and the low speed fuel channel communicating between the emulsifying chamber and the fuel chamber; and the shut-off valve having a closed position preventing air flow to the low speed nozzle through the air bleed line for cold starting of the combustion engine and an open position for hot idle and high speed operating conditions of the combustion engine.

9. The carburetor as set forth in claim 8 wherein the shut off valve is a rotary valve having a closed position for cold starts of the combustion engine and an open position for hot idle and high speed operating conditions of the engine.

10. A carburetor for an internal combustion engine comprising:

a body;

a fuel-and-air mixing passage extending through the body;

a throttle valve disposed within the body;

a fuel chamber defined by the body;

a high speed circuit having a main nozzle, communicating with the fuel-and-air mixing passage upstream of the throttle valve, and a main fuel channel communicating between the main nozzle and the fuel chamber;

a low speed circuit having an emulsifying chamber, a low speed nozzle, an air bleed line, a shut-off valve, a fuel port, and a low speed fuel channel, the low speed nozzle providing an emulsified fuel-and-air mixture from the emulsifying chamber to the fuel-and-air mixing passage downstream of the throttle valve, the air bleed line communicating between the emulsifying chamber and the mixing passage upstream of the throttle valve, the shut off valve communicating with the air bleed line and the low speed fuel channel communicating between the emulsifying chamber and the fuel chamber; and the shut off valve is a rotary valve having a closed position for cold starts of the combustion engine, an open position for hot idle and high speed operating conditions of the engine, and a shaft which extends transversely through the mixing passage upstream of the throttle valve, and intersects the air bleed line.

11. The carburetor as set forth in claim 10 wherein the rotary valve has a lever for manual operation, the lever pivoting about the axis of rotation of the shaft.

12. The carburetor as set forth in claim 11 wherein the low speed circuit has an acceleration port opening into the mixing passage at an axial location over which the throttle valve sweeps when moved from its closed to its opened position, the acceleration port providing air flow from the mixing passage into the emulsifying chamber.

13. The carburetor as set forth in claim 12 wherein the low and high speed flow control valves are threaded needle valves.

14. The carburetor as set forth in claim 13 wherein the fuel chamber is a substantially constant pressure metering chamber defined in part by an inner surface of a diaphragm, and wherein the diaphragm has an opposite outer surface exposed to atmosphere.

* * * * *